US010198999B2

(12) United States Patent
Pyeon

(10) Patent No.: US 10,198,999 B2
(45) Date of Patent: Feb. 5, 2019

(54) ORGANIC LIGHT EMITTING DISPLAY DEVICE AND METHOD OF COMPENSATING FOR IMAGE QUALITY OF ORGANIC LIGHT EMITTING DISPLAY DEVICE

(71) Applicant: LG Display Co., Ltd., Seoul (KR)

(72) Inventor: MyungJin Pyeon, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 101 days.

(21) Appl. No.: 15/389,688

(22) Filed: Dec. 23, 2016

(65) Prior Publication Data

US 2017/0193922 A1 Jul. 6, 2017

(30) Foreign Application Priority Data

Dec. 30, 2015 (KR) ..... 10-2015-0189917

(51) Int. Cl.
*G09G 3/3233* (2016.01)
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 3/3233* (2013.01); *G09G 2300/043* (2013.01); *G09G 2300/0819* (2013.01); *G09G 2300/0842* (2013.01); *G09G 2310/0286* (2013.01); *G09G 2310/08* (2013.01); *G09G 2320/0285* (2013.01); *G09G 2320/0295* (2013.01)

(58) Field of Classification Search
CPC ... G09G 3/3208; G09G 3/30; G09G 2320/045
See application file for complete search history.

(56) References Cited

U.S. PATENT DOCUMENTS

2013/0134986 A1* 5/2013 Yun ..... G09G 3/006 324/543
2014/0009512 A1* 1/2014 Lee ..... G09G 5/02 345/690
2014/0146143 A1* 5/2014 Park ..... H04N 13/0415 348/51
2014/0176516 A1 6/2014 Kim et al.
2014/0176622 A1* 6/2014 Jung ..... G09G 3/3208 345/690
2016/0247445 A1* 8/2016 Zhang ..... G09G 3/3225

FOREIGN PATENT DOCUMENTS

EP 2738757 A1 4/2014
KR 10-2013-0030598 A 3/2013
KR 10-2013-0060476 A 6/2013

* cited by examiner

*Primary Examiner* — Yuzhen Shen
(74) *Attorney, Agent, or Firm* — Morgan, Lewis & Bockius LLP

(57) ABSTRACT

Disclosed is an organic light emitting display device. In a sensing mode of sensing a threshold voltage of a driving transistor, when ripple occurs in a driving voltage applied to a drain of the driving transistor, an error may occur in the sensed threshold voltage. Therefore, when sensing a threshold voltage of a driving transistor, the display device corrects a threshold voltage of a driving transistor of each pixel included in a horizontal line having an error caused by a ripple of a driving voltage, to a threshold voltage of each pixel included in another horizontal line.

8 Claims, 9 Drawing Sheets

FIG. 8

| | | |
|---|---|---|
| 10 | 10 | 10 |
| 10 | 10 | 10 |
| 10 | 10 | 10 |
| 10 | 10 | 10 |
| 10 | 10 | 10 |

(a)

| | | |
|---|---|---|
| 12 | 12 | 12 |
| 12 | 12 | 12 |
| 80 | 84 | 78 |
| 12 | 12 | 12 |
| 12 | 12 | 12 |

(b)

| | | |
|---|---|---|
| 2 | 2 | 2 |
| 2 | 2 | 2 |
| 70 | 74 | 68 |
| 2 | 2 | 2 |
| 2 | 2 | 2 |

(c)

| | | |
|---|---|---|
| 12 | 12 | 12 |
| 12 | 12 | 12 |
| 12 | 12 | 12 |
| 12 | 12 | 12 |
| 12 | 12 | 12 |

(d)

ORGANIC LIGHT EMITTING DISPLAY DEVICE AND METHOD OF COMPENSATING FOR IMAGE QUALITY OF ORGANIC LIGHT EMITTING DISPLAY DEVICE

CROSS-REFERENCE TO RELATED APPLICATIONS

This application claims the benefit of the Korean Patent Application No. 10-2015-0189917, filed on Dec. 30, 2015, which is hereby incorporated by reference as if fully set forth herein.

BACKGROUND

Field of the Invention

The present invention relates to an organic light emitting display device, and more particularly, to a method of compensating for image quality of an organic light emitting display device.

Discussion of the Related Art

Active matrix type organic light emitting display devices include an organic light emitting diode (OLED) which is a self-emitting device, and typically have a fast response time, high emission efficiency, high luminance, and a wide viewing angle.

OLEDs, which are self-emitting devices, typically each include an anode electrode, a cathode electrode, and an organic compound layer formed therebetween. The organic compound layer generally includes a hole injection layer (HIL), a hole transport layer (HTL), an emission layer (EML), an electron transport layer (ETL), and an electron injection layer (EIL). When a driving voltage is applied to the anode electrode and the cathode electrode, a hole passing through the HTL and an electron passing through the ETL move to the EML to generate an exciton, and thus, the EML emits visible light.

In organic light emitting display devices, a plurality of pixels each including an OLED are typically arranged in a matrix type, and luminance of each of the pixels may be adjusted based on a gray scale of video data. Each of the pixels typically includes a driving transistor for controlling a driving current which flows in the OLED. It may be preferable that all the pixels are designed to have the same electrical characteristics of the driving transistor such as a threshold voltage, mobility, etc., but the driving transistors of the pixels actually have non-uniform electrical characteristics due to a process condition, a driving environment, and/or the like. For this reason, even when the same data voltage is applied, driving currents of the pixels differ, and consequently, a luminance deviation between the pixels occurs.

To solve such a problem, image quality compensation technology may sense the threshold voltage of the driving transistor of each pixel and appropriately correct input data according to a result of the sensing to reduce the non-uniformity of luminance. Hereinafter, a method of sensing a threshold voltage of a driving transistor and a method of compensating for input data according to a sensing result will be briefly described.

FIG. 1 is a conceptual diagram illustrating a method of sensing a threshold voltage of a driving transistor. As illustrated in FIG. 1, a driving transistor Tdr is driven in a source follower mode, sensing data Sdata is generated by sensing a source voltage Vs of the driving transistor Tdr, and a threshold voltage Vth of the driving transistor Tdr is calculated based on the sensing data Sdata. Subsequently, compensation data corresponding to the calculated threshold voltage of the driving transistor Tdr is calculated, and by reflecting the calculated compensation data in input data, the input data is compensated for.

However, a driving voltage EVDD, which is applied to a drain of the driving transistor Tdr for sensing the threshold voltage of the driving transistor Tdr, is directly applied to the driving transistor Tdr without passing through a transistor. Thus, as illustrated in FIG. 2, when ripple occurs in the driving voltage, an error may also occur in the threshold voltage obtained from the sensing data Sdata. For this reason, an error may inevitably occur in the compensation data calculated based on the threshold voltage, and thus, in a case of compensating for the input data by reflecting the compensation data in the input data, as illustrated in FIG. 3, a horizontal line defect occurs in a screen.

SUMMARY

Accordingly, embodiments of the present invention are directed to provide an organic light emitting display device and a method of compensating for image quality of the organic light emitting display device that substantially obviate one or more problems due to limitations and disadvantages of the related art.

An object of the present invention is directed to provide an organic light emitting display device and a method of compensating for image quality of an organic light emitting display device, which correct an error of characteristic data caused by a ripple of a driving voltage applied to a driving transistor when sensing the characteristic data of the driving transistor.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an organic light emitting display device including a determiner configured to determine whether ripple occurs in a driving voltage supplied to each pixel of a plurality of pixels included in a display panel, a detector configured to, when it is determined that the ripple occurs in the driving voltage, detect a horizontal line having an error, based on a deviation between nth characteristic data obtained through nth sensing and n+1st characteristic data obtained through n+1st sensing for a driving transistor of each pixel, wherein "n" and "n+1" refer to two sequential data periods, a data corrector configured to correct n+1st characteristic data of pixels included in the horizontal line having the error using n+1st characteristic data of pixels included in another horizontal line and store the corrected n+1st characteristic data in a memory, and a data processor configured to compensate for input data which is to be supplied to each pixel using the characteristic data stored in the memory.

In another aspect of the present invention, there is provided a method of compensating for image quality of an organic light emitting display device, the method including determining whether ripple occurs in a driving voltage supplied to each pixel of a plurality of pixels included in a display panel, detecting a deviation between nth characteristic data obtained through nth sensing of a driving transistor of each pixel and n+1st characteristic data obtained through n+1st sensing when it is determined that the ripple occurs in the driving voltage, wherein "n" and "n+1" refer to two sequential data periods, detecting a horizontal line, including a pixel where the deviation is equal to or more than a reference value, from among horizontal lines of the display panel, correcting n+1st characteristic data of pixels included in the detected horizontal line, based on n+1st characteristic data of pixels included in another horizontal line, and compensating for input data which is to be supplied to each pixel, based on the corrected n+1st characteristic data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings:

FIG. 8 is a diagram conceptually illustrating a method of correcting sensing data according to an embodiment of the present invention;

DETAILED DESCRIPTION

Reference will now be made in detail to the exemplary embodiments of the present invention, examples of which are illustrated in the accompanying drawings. Wherever possible, the same reference numbers will be used throughout the drawings to refer to the same or like parts.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Hereinafter, embodiments of the present invention will be described in detail with reference to the accompanying drawings.

Figure 4:
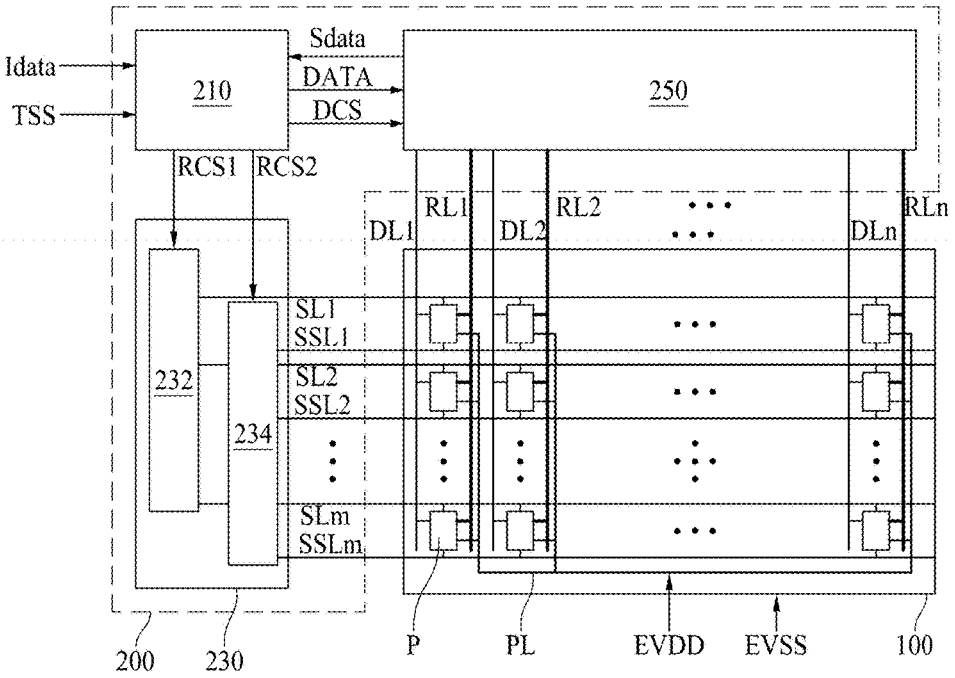
FIG. 4 is a diagram schematically illustrating a configuration of an organic light emitting display device according to an embodiment of the present invention.
Figure 5:
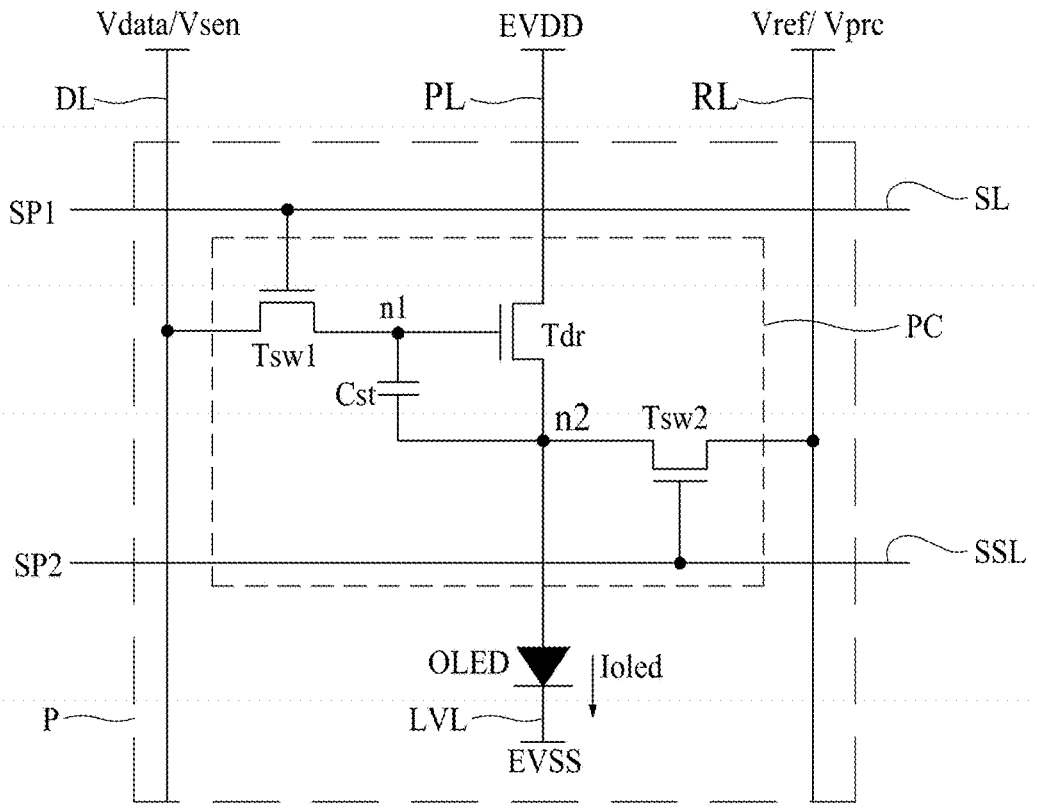
FIG. 5 is a circuit diagram illustrating a configuration of a pixel illustrated in FIG. 4.

FIG. 4 is a diagram schematically illustrating a configuration of an organic light emitting display device according to an embodiment of the present invention, and FIG. 5 is a circuit diagram illustrating a configuration of a pixel illustrated in FIG. 4.

With reference to FIGS. 4 and 5, the organic light emitting display device according to an embodiment of the present invention may include a display panel 100 and a panel driver 200.

The display panel 100 may include first to mth (where m is a natural number) scan lines SL1 to SLm, first to mth sensing lines SSL1 to SSLm, first to nth (where n is a natural number more than m) data lines DL1 to DLn, first to nth reference lines RL1 to RLn, a plurality of high-level voltage lines PL, a low-level voltage line LVL, and a plurality of pixels P.

The first to mth scan lines SL1 to SLm may be arranged at certain intervals in parallel along a first direction (for example, a widthwise direction) of the display panel 100. The first to mth sensing lines SSL1 to SSLm may be arranged at certain intervals in parallel with the first to mth scan lines SL1 to SLm.

The first to nth data lines DL1 to DLn may be arranged at certain intervals in parallel along a second direction (for example, a lengthwise direction) of the display panel 100 to intersect the first to mth scan lines SL1 to SLm and the first to mth scan lines SL1 to SLm. The first to nth reference lines RL1 to RLn may be arranged at certain intervals in parallel with the first to nth data lines DL1 to DLn.

Each of the first to nth reference lines RL1 to RLn may be individually connected to a pixel P provided on a horizontal line corresponding to a lengthwise direction of each of the scan lines SL1 to SLm, and may be connected in common to pixels P arranged on a vertical line corresponding to a lengthwise direction of a corresponding data line of the data lines DL1 to DLn. That is, each of first to nth reference lines RL1 to RLn may be connected in common to pixels P arranged in a pixel column of the display panel 100 and may be individually connected to a corresponding pixel of pixels P arranged in a pixel row of the display panel 100.

The plurality of high-level voltage lines PL may be arranged at certain intervals in parallel with the data lines DL1 to DLn. Here, the plurality of high-level voltage lines PL may be arranged at certain intervals in parallel with the scan lines SL1 to SLn. Each of the plurality of high-level voltage lines PL may be supplied with a high-level driving voltage EVDD from an external high-level voltage supply unit (not shown) through a driving power common line (not shown) which is provided on an upper side and/or a lower side of the display panel 100.

The low-level voltage line LVL may be provided in a one-piece form all over the display panel 100, or may be provided in plurality. In a case where the low-level voltage line LVL is provided in plurality, the plurality of low-level voltage lines LVL may be arranged at certain intervals in parallel with the data lines DL1 to DLn or the scan lines SL1 to SLm. The low-level voltage line LVL may be supplied with a low-level driving voltage EVSS from an external low-level voltage supply unit (not shown).

The plurality of pixels P may be respectively provided in a plurality of pixel areas defined by the first to mth scan lines SL1 to SLm and the first to nth data lines DL1 to DLn. Here, each of the plurality of pixels P may be one of a red pixel, a green pixel, a blue pixel, and a white pixel. Also, i (where i is a natural number equal to or more than three) number of pixels adjacent to each other among the plurality of pixels P may configure one unit pixel which displays one image. For example, each of unit pixels may be configured with a red pixel, a green pixel, a blue pixel, and a white pixel which are adjacent to each other, or may be configured with a red pixel, a green pixel, and a blue pixel which are adjacent to each other.

In an embodiment, as illustrated in FIG. 5, each of the plurality of pixels P may be configured with a pixel circuit PC which includes an organic light emitting device OLED, a first switching transistor Tsw1, a second switching transistor Tsw2, a driving transistor Tdr, and a capacitor Cst. Here, each of the transistors Tsw1, Tsw2, and Tdr may be an N-type thin film transistor (TFT), and for example, may be an amorphous-silicon (a-Si) TFT, a poly-Si TFT, an oxide TFT, an organic TFT, or the like.

The first switching transistor Tsw1 may be turned on by a first scan pulse SP1 supplied through a scan line SL and may supply a voltage Vdata or Vsen, supplied through a data line DL, to a gate electrode of the driving transistor Tdr according to an operation mode of the organic light emitting display device. The first switching transistor Tsw1 may include a gate electrode connected to the scan line SL adjacent thereto, a first electrode connected to the data line DL adjacent thereto, and a second electrode connected to a first node n1 which is the gate electrode of the driving transistor Tdr. Each of the first and second electrodes of the first switching transistor Tsw1 may be a source electrode or a drain electrode depending on a direction in which a current flows.

The second switching transistor Tsw2 may be turned on by a second scan pulse SP2 supplied through a sensing line SSL and may supply a voltage Vref or Vpre, supplied through a reference line RL, to a second node n2 which is a source electrode of the driving transistor Tdr, based on the operation mode of the organic light emitting display device. The second switching transistor Tsw2 may include a gate electrode connected to the sensing line SSL adjacent thereto, a first electrode connected to the reference line RL adjacent thereto, and a second electrode connected to the second node n2. Each of the first and second electrodes of the second switching transistor Tsw2 may be a source electrode or a drain electrode depending on a direction in which a current flows.

The capacitor Cst may include a first electrode and a second electrode which are connected between a gate electrode and a source electrode of the driving transistor Tdr, for example, the first node n1 and the second node n2. The first electrode of the capacitor Cst may be connected to the first node n1, and the second node of the capacitor Cst may be connected to the second node n2. The capacitor Cst may be charged with a difference voltage between voltages respectively supplied to the first and second nodes n1 and n2 according to each of the first and second switching transistors Tsw1 and Tsw2 being turned on, and then, the driving transistor Tdr may be driven with a voltage charged into the capacitor Cst.

The driving transistor Tdr may be driven with a difference voltage between a gate voltage and a source voltage to control the amount of current which flows from the high-level voltage line PL to the organic light emitting device OLED. The driving transistor Tdr may include the gate electrode connected to the first node n1, the source electrode connected to the second node n2, and the drain electrode connected to the high-level voltage line PL.

The organic light emitting device OLED may emit light with a data current Ioled which flows according to the driving of the driving transistor Tdr, thereby emitting a single color light having luminance corresponding to the data current Ioled. The organic light emitting diode OLED may include a first electrode (for example, an anode electrode) connected to the second node n2, an organic layer (not shown) provided on the first electrode, and a second electrode (for example, a cathode electrode) connected to the organic layer.

The organic layer may be provided to have a structure of a hole transport layer/organic emission layer/electron transport layer, or may be provided to have a structure of a hole injection layer/hole transport layer/organic emission layer/electron transport layer/electron injection layer. The organic layer may further include a function layer for enhancing the emission efficiency and/or lifetime of the organic emission layer. The second electrode may be connected to the low-level power line LVL or may become the low-level power line LVL.

Figure 1:
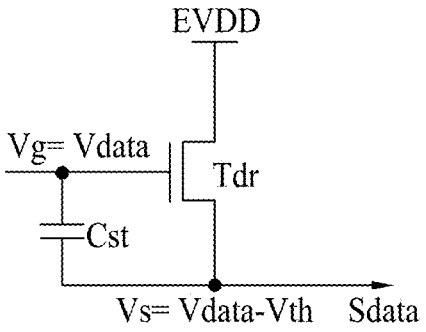
FIG. 1 RELATED ART
FIG. 1 is a diagram illustrating the general principle of sensing a threshold of a driving transistor.
Figure 1:
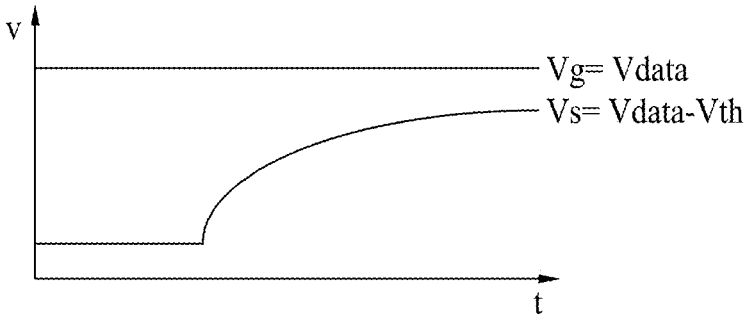
FIG. 1 RELATED ART
Figure 2:
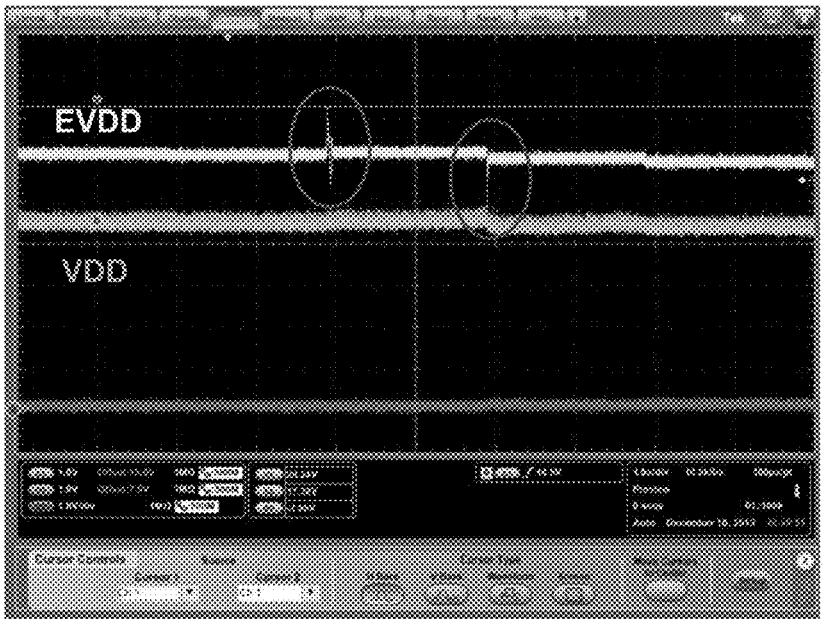
FIG. 2 RELATED ART
FIG. 2 is a diagram illustrating a ripple of a driving voltage applied to a driving transistor.
Figure 3:
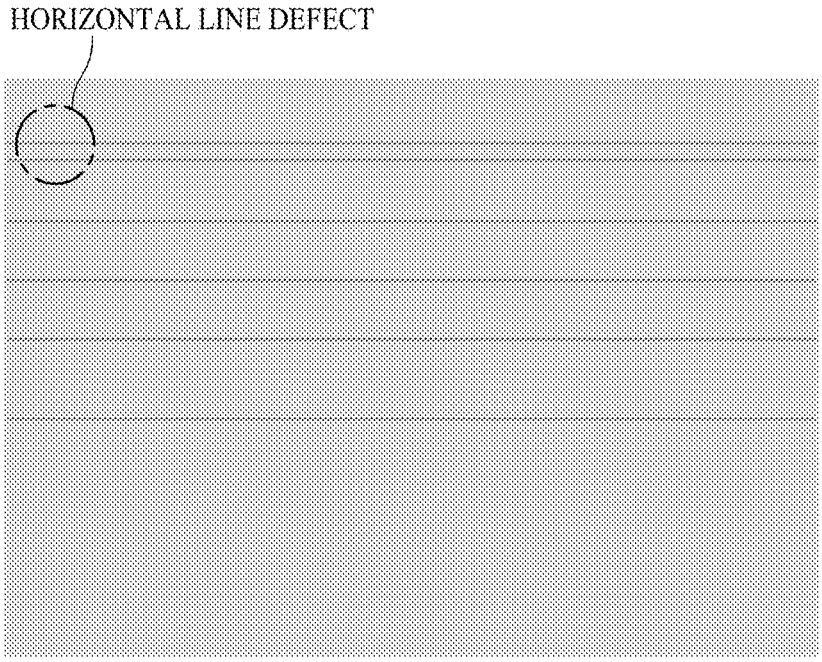
FIG. 3 RELATED ART
FIG. 3 is a diagram illustrating a horizontal line defect which occurs in a screen due to a ripple of a driving voltage applied to a driving transistor.

With further reference to FIG. 1, the panel driver 200 operates the display panel 100 according to the operation mode of the display panel 100. In an embodiment, the panel driver 200 operates the display panel 100 in a sensing mode or a display mode.

The sensing mode denotes a pixel driving mode for sensing a threshold voltage Vth, which is the electrical characteristic of the driving transistor Tdr in each of the plurality of pixels. The sensing mode may be performed at every predetermined period, or may be performed at every power-on period of the organic light emitting display device, power-off period of the organic light emitting display device, power-on period after a predetermined driving time, or power-off period after the predetermined driving time. In an embodiment, the sensing mode may be performed in the power-off period where a user does not view an image.

The display mode denotes a pixel driving mode for displaying an image on each pixel P by correcting a data voltage supplied to a corresponding pixel P, based on the electrical characteristic of each subpixel P sensed in the sensing mode.

The panel driver 200 includes a timing controller 210, a scan driver 230, and a data driver 250.

The timing controller 210 operates each of the scan driver 230 and the data driver 240 in the sensing mode or the display mode, based on a vertical synchronization signal of a timing synchronization signal TSS or a power-on/off signal PS input from an external driving system. The timing synchronization signal TSS may include the vertical synchronization signal, a horizontal synchronization signal, a data enable signal, a clock signal, etc.

In detail, in the sensing mode, the timing controller 210 operates the driving transistor Tdr of each pixel P in a source follower mode to generate control signals DCS, RCS1, and RCS2 and sensing pixel data DATA for sensing the threshold voltage Vth of the driving transistor Tdr in each pixel. The sensing pixel data DATA may have a grayscale value corresponding to a predetermined target voltage for operating the driving transistor Tdr in the source follower mode.

In the display mode, the timing controller 210 generates compensation data, based on sensing data Vsen of each pixel supplied from the data driver 250 and compensates for pixel-based input data Idata input from an external driving system (or a graphic card) with compensation data of a corresponding pixel to generate pixel-based pixel data DATA. In this case, the sensing data may include the threshold voltage Vth or mobility of the driving transistor Tdr of each pixel.

The timing controller 210 supplies the generated pixel-based pixel data DATA to the data driver 250. Based on the timing synchronization signal TSS, the timing controller 210 generates a data control signal DCS for controlling the data driver 250 to transfer the data control signal DCS to the data driver 250, and generates first and second row control signals RCS1 and RCS2 for controlling the scan driver 230 to transfer the first and second row control signals RCS1 and RCS2 to the scan driver 230.

In a case where one unit pixel provided in the display panel 100 is configured with a red pixel, a green pixel, a blue pixel, and a white pixel, the timing controller 210 may convert red, green, and blue input data Idata into four-color data (for example, red, green, blue, and white data) based on a four color data conversion method (RGB to RWGB). The four color data conversion method (RGB to RWGB) may be set according to the luminance characteristic of each unit pixel based on characteristics such as the luminance and/or driving of each pixel P. The timing controller 210 may correct four-color data obtained through conversion based on the threshold voltage Vth of the driving transistor Tdr included in each of the red pixel, the green pixel, the blue pixel, and the white pixel to generate the pixel-based pixel data DATA.

In this case, the timing controller 210 may convert the red, green, and blue input data Idata into the four-color data (for example, the red, green, blue, and white data) according to data conversion methods disclosed in Korean Patent Publication Nos. 10-2013-0060476 and 10-2013-0030598.

Hereinafter, the timing controller 210 according to an embodiment of the present invention will be described in more detail with reference to the accompanying drawings.

Figure 6:
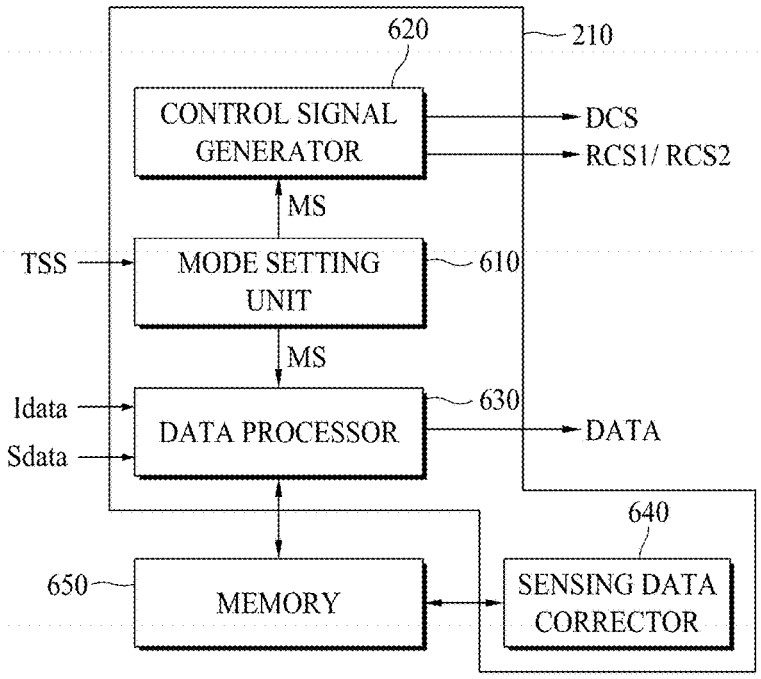
FIG. 6 is a block diagram schematically illustrating a configuration of a timing controller illustrated in FIG. 4.

FIG. 6 is a block diagram schematically illustrating a configuration of the timing controller 210 according to an embodiment of the present invention.

As illustrated in FIG. 6, the timing controller 210 according to an embodiment of the present invention includes a mode setting unit 610, a control signal generator 620, a data processor 630, and a sensing data corrector 640.

The mode setting unit 610 generates a first-logic-level mode signal MS indicating the sensing mode or a second-logic-level mode signal MS indicating the display mode, based on the timing synchronization signal TSS and the power-on/off signal PS input from an external system body (not shown) or a graphic card (not shown).

The control signal generator 620 generates the data control signal DCS and the first and second row control signals RCS1 and RCS2 corresponding to the mode signal MS supplied from the mode setting unit 620, based on the timing synchronization signal TSS. The control signal generator 620 transfers the data control signal DCS and the first and second row control signals RCS1 and RCS2 to the scan driver 230 and the data driver 250.

If the mode signal MS supplied from the mode setting unit 610 is the first-logic-level mode signal, the data processor 630 supplies the sensing pixel data DATA to the data driver 250 and obtains the threshold voltage Vth of each pixel based on the sensing data Sdata transferred from the data driver 250 to store the threshold voltage Vth of each pixel in a memory 650.

Moreover, if the mode signal MS supplied from the mode setting unit 610 is the second-logic-level mode signal, the data processor 630 generates the compensation data based on the threshold voltage of each pixel stored in the memory 650 and reflects the compensation data in the pixel-based input data Idata input from the outside to compensate for the input data, thereby generating the pixel-based pixel data DATA.

In this case, the data processor 630 may calculate a deviation between a compensation value corresponding to the threshold voltage of each pixel and an initial compensation value (or a previous compensation value) for the driving transistor Tdr of each pixel, and then, may add or subtract the calculated deviation to or from the initial compensation value (or the previous compensation value) to generate the compensation data.

In the sensing mode, the sensing data corrector 640 determines whether an error occurs in characteristic data of the driving transistor sensed from each pixel, based on whether a ripple of the driving voltage EVDD supplied to each pixel occurs. When the error occurs in the characteristic data, the sensing data corrector 640 corrects the characteristic data.

Hereinafter, the sensing data corrector 640 will be described in more detail with reference to FIG. 7.

Figure 7:
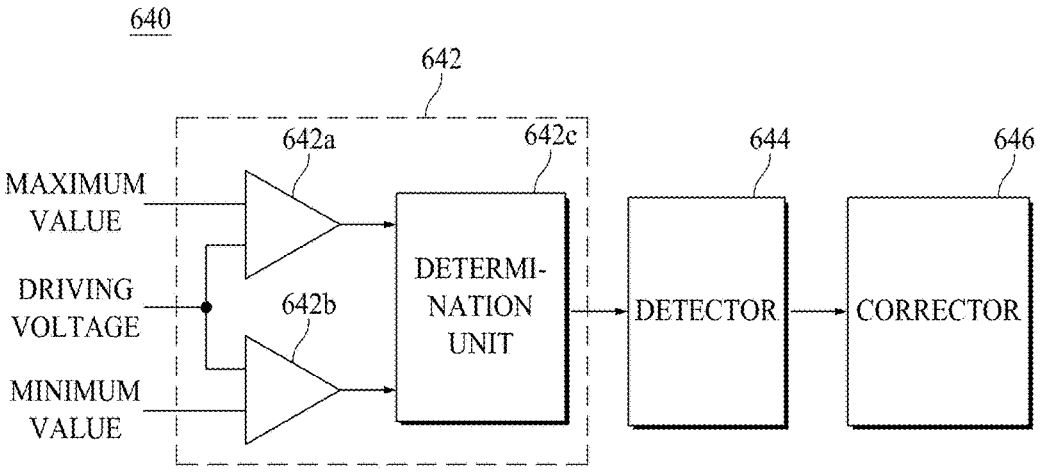
FIG. 7 is a block diagram schematically illustrating a configuration of a sensing data corrector illustrated in FIG. 6.

FIG. 7 is a block diagram schematically illustrating a configuration of the sensing data corrector 640 according to an embodiment of the present invention.

As illustrated in FIG. 7, the sensing data corrector 640 according to an embodiment of the present invention includes a determiner 642, a detector 644, and a corrector 646.

First, the determiner 642 determines whether a ripple of the driving voltage EVDD supplied from a power supply (not shown) to each pixel occurs. To this end, the determiner 642 includes a first comparator 642*a*, a second comparator 642*b*, and a determination unit 642*c*.

The first comparator 642*a* determines whether a level of the driving voltage EVDD supplied to each pixel is equal to or more than a predetermined maximum value. When it is determined that the level of the driving voltage EVDD is equal to or more than the predetermined maximum value, the first comparator 642*a* may output "1", and when it is determined that the level of the driving voltage EVDD is less than the predetermined maximum value, the first comparator 642*a* may output "0".

The second comparator 642*b* determines whether the level of the driving voltage EVDD supplied to each pixel is equal to or less than a predetermined minimum value. When it is determined that the level of the driving voltage EVDD is equal to or less than the predetermined minimum value, the second comparator 642*b* may output "1", and when it is determined that the level of the driving voltage EVDD is more than the predetermined minimum value, the second comparator 642*b* may output "0".

The determination unit 642*c* determines whether ripple occurs in the driving voltage EVDD, based on a comparison result of each of the first and second comparators 642*a* and 642*b*. In detail, when at least one of the first and second comparators 642*a* and 642*b* outputs "1", the determination unit 642*c* may determine that ripple occurs in the driving voltage EVDD. In an embodiment, the determination unit 642*c* may be implemented with an OR gate.

When it is determined by the determiner 642 that the ripple of the driving voltage occurs, the detector 644 calculates a deviation between nth characteristic data obtained through nth sensing and n+1st characteristic data obtained through n+1st sensing for the driving transistor of each pixel. In this case, the detector 644 may receive the nth characteristic data and the n+1st characteristic data from the memory 650. Here, the characteristic data may include the threshold voltage of the driving transistor obtained based on the sensing data.

The detector 644 may subtract the nth characteristic data of each pixel from the n+1st characteristic data of a corresponding pixel to calculate the deviation between the nth characteristic data and the n+1st characteristic data.

For example, when the nth characteristic data illustrated in portion (a) of FIG. 8 is stored in the memory 650 and the n+1st characteristic data illustrated in portion (b) of FIG. 8 is stored in the memory 650, the detector 644 may subtract the nth characteristic data illustrated in portion (a) of FIG. 8 from the n+1st characteristic data illustrated in portion (b) of FIG. 8 to calculate a deviation illustrated in portion (c) of FIG. 8.

Subsequently, the detector 644 detects a horizontal line, including a pixel where the deviation calculated by the detector 644 is equal to or more than a reference value, as a horizontal line having an error among horizontal lines included in the display panel 100.

In an embodiment, when a deviation between nth characteristic data and n+1st characteristic data of a specific pixel is equal to or more than an average value of n+1st characteristic data of m number of pixels arranged above the specific pixel and n+1st characteristic data of m number of pixels arranged under the specific pixel on a vertical line including the specific pixel, the detector 644 may detect a horizontal line, including the specific pixel, as a horizontal line where an error occurs.

For example, in portion (c) of FIG. 8, a deviation of a first pixel disposed at a first position on a third horizontal line is 70, and an average value of n+1st characteristic data of two pixels arranged above the first pixel and n+1st characteristic data of two pixels arranged under the first pixel on a first vertical line including the first pixel is 12, whereby a third horizontal line including the first pixel may be determined as a horizontal line where an error occurs.

As described above, according to an embodiment of the present invention, because a horizontal line where an error occurs is detected based on an average value of characteristic data of pixels which are arranged above and under a specific pixel and are high in possibility of having characteristic data similar to characteristic data of the specific pixel, the accuracy of detection of a horizontal line where an error occurs may be enhanced.

With reference again to FIG. 7, the corrector 646 corrects n+1st characteristic data of each of pixels included in a horizontal line determined as having an error. In detail, the corrector 646 corrects the n+1st characteristic data of each of the pixels included in the horizontal line determined as having an error, based on n+1st characteristic data of pixels included in another horizontal line except the horizontal line having the error.

In an embodiment, the corrector 646 may correct n+1st characteristic data of each of pixels included in a horizontal line determined as having an error using n+1st characteristic data of a pixel disposed just above each of pixels on a vertical line including a corresponding pixel. In this case, if the horizontal line determined as having the error is an uppermost horizontal line in the display panel 100, the corrector 646 corrects the n+1st characteristic data of each pixel included in the horizontal line determined as having the error, using the n+1st characteristic data of a pixel disposed just under each of pixels on a vertical line including a corresponding pixel.

For example, a method of correcting, by the corrector 646, n+1st characteristic data of each of pixels included in a horizontal line determined as having an error will be described in detail with reference to an example illustrated in portion (b) of FIG. 8.

As an example illustrated in portion (b) of FIG. 8, characteristic data of a first pixel on a third horizontal line where an error occurs is 80, and characteristic data of a pixel disposed above the first pixel is 12, whereby the corrector 646 corrects 80, which is characteristic data of the first pixel on the third horizontal line, to 12. Also, characteristic data of a second pixel on the third horizontal line where the error occurs is 84, and characteristic data of a pixel disposed above the second pixel is 12, whereby the corrector 646 corrects 84, which is characteristic data of the third pixel on the third horizontal line, to 12. Also, characteristic data of a third pixel on the third horizontal line is 78, and characteristic data of a pixel disposed above the third pixel is 12, whereby the corrector 646 corrects 78, which is characteristic data of the first pixel on the third horizontal line to 12. Accordingly, the n+1st characteristic data illustrated in portion (b) of FIG. 8 may be corrected as illustrated in portion (d) of FIG. 8.

As described above, according to an embodiment of the present invention, because characteristic data of each of pixels included in a horizontal line where an error occurs is corrected to characteristic data of a pixel included in a horizontal line (a horizontal line disposed above or under the horizontal line where the error occurs) which is expected to have characteristic data similar to those of the pixels included in the horizontal line where the error occurs, the accuracy of correction of a horizontal line where an error occurs may be enhanced.

In the above-described embodiment, it has been described that the corrector 646 corrects n+1st characteristic data of each of pixels included in a horizontal line determined as having an error, to n+1st characteristic data of a pixel disposed just above each of pixels on a vertical line including a corresponding pixel.

However, in an example modified embodiment, the corrector 646 may correct n+1st characteristic data of each of pixels included in a horizontal line determined as having an error, to an average value or an intermediate value of n+1st characteristic data of m number of pixels arranged above each of pixels on a vertical line including a corresponding pixel.

In another embodiment, the corrector 646 may correct n+1st characteristic data of each of pixels included in a horizontal line determined as having an error, to an average value or an intermediate value of n+1st characteristic data of m number of pixels arranged under each of the pixels.

In another embodiment, the corrector 646 may correct n+1st characteristic data of each of pixels included in a horizontal line determined as having an error, to an average value or an intermediate value of n+1st characteristic data of m number of pixels arranged above each of the pixels and n+1st characteristic data of m number of pixels arranged under each of the pixels.

As described above, according to an embodiment of the present invention, because characteristic data of each of pixels included in a horizontal line where an error occurs is corrected to an average value or an intermediate value of characteristic data of pixels included in a plurality of horizontal lines (a plurality of horizontal lines disposed above or under the horizontal line where the error occurs) which is expected to have characteristic data similar to those of the pixels included in the horizontal line where the error occurs, the accuracy of correction of a horizontal line where an error occurs may be enhanced.

The corrector 646 updates n+1st characteristic data, stored in the memory 650, to corrected n+1st characteristic data. Therefore, the data processor 630 may read the updated n+1st characteristic data from the memory 650 to generate compensation data, and may reflect the compensation data in input data to compensate for the input data.

When ripple occurs in the driving voltage in initially sensing each pixel, the detector 644 may not be able to calculate a deviation between characteristic data, and thus, the corrector 646 may correct initially-sensed characteristic data to initial characteristic data which is stored in the memory 650 when releasing a product, and may store the corrected characteristic data in the memory 650.

As described above, according to an embodiment of the present invention, whether ripple occurs in the driving voltage supplied to each pixel may be determined, and when the ripple occurs in the driving voltage as a result of the determination, an error of characteristic data caused by the ripple may be corrected, thereby preventing a horizontal line defect of a screen from occurring due to the use of characteristic data where an error occurs.

With further reference to FIG. 4, the scan driver 230 is connected to the first to mth scan lines SL1 to SLm and the first to mth sensing lines SSL1 to SSLm, and operates in the sensing mode or the display mode according to mode control by the timing controller 210.

The scan driver 230 includes a scan line driver 232 and a sensing line driver 234. The scan line driver 232 is connected to one side and/or the other side of each of the first to mth scan lines SL1 to SLm. The scan line driver 232 generates the first scan pulse SP1 and supplies the first scan pulse SP1 to the first to mth scan lines SL1 to SLm, in response to the first row control signal RCS1, which is based on the sensing mode or the display mode and is supplied from the timing controller 210.

The sensing line driver 234 is connected to one side and/or the other side of each of the first to mth sensing lines SSL1 to SSLm. The sensing line driver 234 generates the second scan pulse SP2 and supplies the second scan pulse SP2 to the first to mth sensing lines SSL1 to SSLm, in response to the second row control signal RCS2, which is based on the sensing mode or the display mode and is supplied from the timing controller 210.

In the sensing mode, each of the first and second scan pulses SP1 and SP2 may be modified to various forms to correspond to a pixel arrangement structure and a sensing method of sensing the threshold voltage of the driving transistor Tdr.

The data driver 250 is connected to the first to nth data lines DL1 to DLn and the first to nth reference lines RL1 to RLn, and operates in the sensing mode or the display mode according to mode control by the timing controller 210.

In the sensing mode, in response to the data control signal DCS, the data driver 250 converts the sensing pixel data DATA into a sensing data voltage Vsen and supplies the sensing data voltage Vsen to a corresponding data line DL. Also, the data driver 250 senses a source voltage of the driving transistor Tdr included in each pixel P through a corresponding reference line of the reference lines RL1 to RLn to generate the sensing data Sdata, and supplies the generated sensing data Sdata to the timing controller 210.

In the display mode, in response to the data control signal DCS, the data driver 250 converts pixel-based pixel data DATA for one horizontal line, which is input in units of one horizontal period, into a data voltage Vdata. The data driver 250 supplies the data voltage Vdata to a corresponding data line DL. Optionally, the data driver 250 may supply the data voltage Vdata to the corresponding data line DL and may supply a reference voltage Vref, supplied from the outside, to a corresponding reference line RL.

Figure 9:
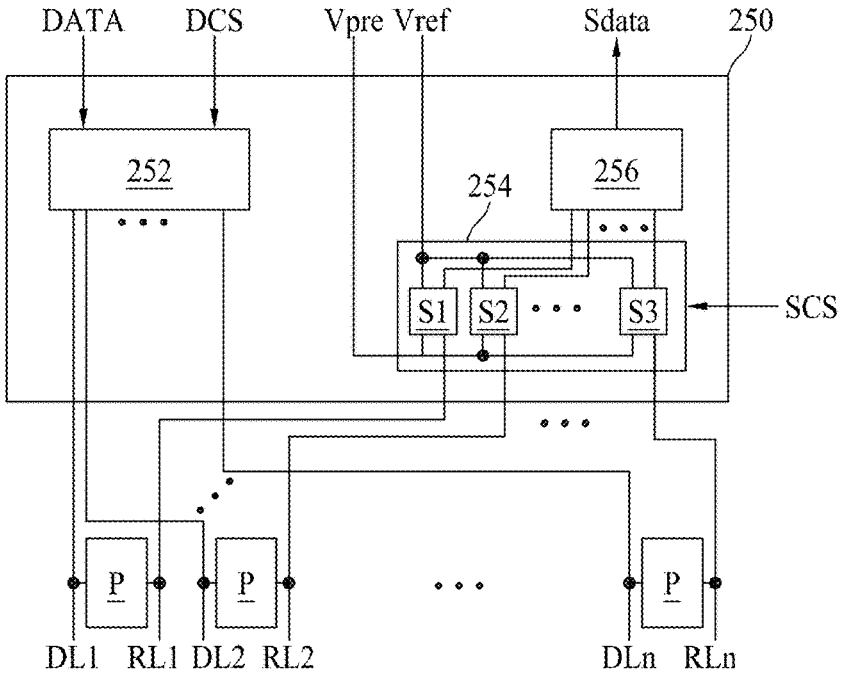
FIG. 9 is a block diagram illustrating a configuration of a data driver illustrated in FIG. 4.

FIG. 9 is a block diagram illustrating a configuration of the data driver 250 according to an embodiment of the present invention illustrated in FIG. 4.

With reference to FIGS. 4, 5, and 9, the data driver 250 according to an embodiment of the present invention includes a data driving unit 252, a switching unit 254, and a sensing unit 256. In response to the data control signal DCS supplied from the timing controller 210 according to the sensing mode or the display mode, the data driving unit 252 converts input pixel data DATA into an analog voltage Vdata or Vsen and supplies the analog voltage to a corresponding data line DL. To this end, the data driving unit 252 includes a shift register, a latch unit, a grayscale voltage generator, and a digital-to-analog converter (DAC).

The shift register generates a sampling signal by using a source start signal and a source shift clock, which are included in the data control signal DCS. In detail, the shift register shifts the source start signal according to the source shift clock to sequentially output the sampling signal.

The latch unit may sequentially sample and latch the input pixel data DATA according to the sampling signal, and may simultaneously output latch data for one horizontal line according to a source output enable signal of the data control signal DCS.

The grayscale voltage generator may generate a plurality of different grayscale voltages GV corresponding to the number of gray scales of the pixel data DATA by using a plurality of gamma voltages RGV input from the outside.

The DAC may select a grayscale voltage, corresponding to the latch data among the plurality of grayscale voltages GV supplied from the grayscale voltage generator, as a data voltage Vdata, and may output the data voltage Vdata to a corresponding data line of the data lines DL1 to DLn.

The data driving unit 252 supplies the sensing data voltage Vsen in the sensing mode and the data voltage Vdata in the display mode to the corresponding data line DL.

The switching unit 254 may include first to nth switching circuits S1 to Sn, which are connected to the first to nth reference lines RL1 to RLn and the sensing unit 256 and are turned on according to a switching control signal SCS.

In the sensing mode, each of the first to nth switching circuits S1 to Sn may supply a pre-charging voltage Vpre (or the reference voltage Vref), supplied from the outside, to a corresponding reference line RL, and may connect the corresponding reference line RL to the sensing unit 256.

In the display mode, each of the first to nth switching circuits S1 to Sn may supply the reference voltage Vref, supplied from the outside, to a corresponding reference line RL, but embodiments are not limited thereto.

In the sensing mode, the sensing unit 256 may be connected to the first to nth reference lines RL1 to RLn through the switching unit 254 to sense a voltage of each of the first to nth reference lines RL1 to RLn, and may generate sensing data S data corresponding to the sensed voltage to supply the sensing data Sdata to the timing controller 210. To this end, the sensing unit 256 may include first to nth analog-to-digital converters (ADCs), which are respectively connected to the first to nth reference lines RL1 to RLn through the switching unit 254.

Figure 10:
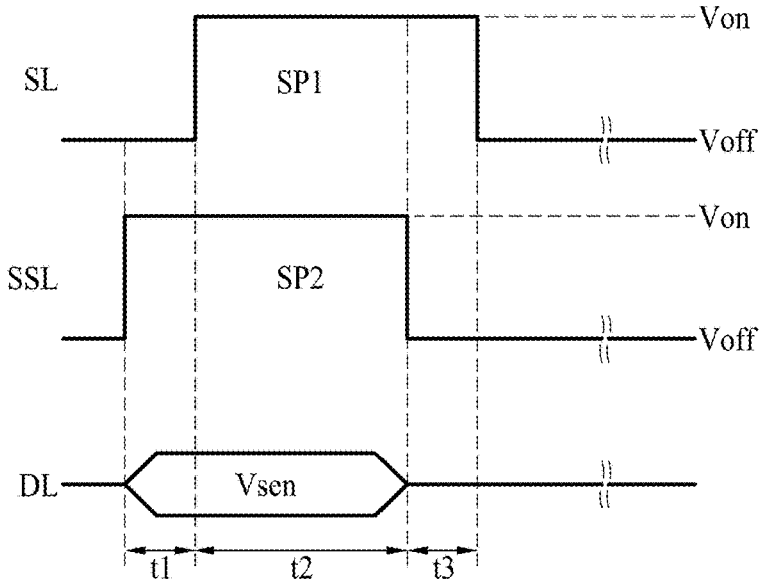
FIG. 10 is a waveform diagram showing waveforms of signals applied to each pixel during a sensing mode.

FIG. 10 is a driving waveform diagram of one representative pixel in the sensing mode in the organic light emitting display device according to an embodiment of the present invention.

A driving method of an organic light emitting display device according to an embodiment of the present invention in the sensing mode will be described below with reference to FIGS. 4 to 10.

In the sensing mode, in a first period t1, the second switching transistor Tsw2 is turned on by the second scan pulse SP2 having a gate-on voltage, and thus, the pre-charging voltage Vpre (or the reference voltage Vref) supplied to the reference line RL is supplied to the second node n2 (i.e., the source electrode of the driving transistor Tdr), whereby the source voltage of the driving transistor Tdr and the reference line RL is initialized to the pre-charging voltage Vpre. After the initialization, the first switching transistor Tsw1 is turned on by the first scan pulse SP1 having the gate-on voltage, and thus, the sensing data voltage Vsen supplied to the data line DL is supplied to the first node n1 (i.e., the gate electrode of the driving transistor Tdr). At this time, in order to prevent the organic light emitting device OLED from emitting light according to the driving transistor Tdr being driven with the sensing data voltage Vsen, the first switching transistor Tsw1 may be turned on at a certain time later than the second switching transistor Tsw2. At this time, during the first period t1, the organic light emitting device OLED does not emit light with the pre-charging voltage Vpre which is supplied to the second node n2 through the second switching transistor Tsw2.

Subsequently, in a second period t2, while the first and second switching transistors Tsw1 and Tsw2 are respectively driven in a linear driving mode by the scan pulses SP1 and SP2 having the gate-on voltage, the reference line RL is changed to a floating state according to the turn-on of the switching unit 254. Therefore, the driving transistor Tdr operates in the source follower mode with the sensing data voltage Vsen, which is a bias voltage supplied to the gate electrode, and thus, a difference voltage "Vsen−Vth" between a data voltage Vdata and the threshold voltage Vth of the driving transistor Tdr is charged into the reference line RL, which is in the floating state.

Subsequently, in a third period t3, while the first switching transistor Tsw1 is maintained in a turn-on state, the second switching transistor Tsw2 is turned off by the second scan pulse SP2 having a gate-off voltage, and simultaneously, the reference line RL is connected to the sensing unit 256 by the switching unit 254. Therefore, the sensing unit 256 senses a voltage charged into the reference line RL, analog-to-digital converts the sensed voltage to generate the sensing data Sdata, and supplies the sensing data Sdata to the timing controller 210.

Therefore, the timing controller 210 calculates the threshold voltage Vth of the driving transistor Tdr based on the sensing data Sdata and the sensing data voltage Vsen supplied from the sensing unit 256 in the third period t3 and stores the calculated threshold voltage Vth of the driving transistor Tdr in the memory 650. In this case, the threshold voltage Vth of the driving transistor Tdr may be a voltage obtained by subtracting a sensing voltage of the sensing unit 256 from the sensing data voltage Vsen.

Figure 11:
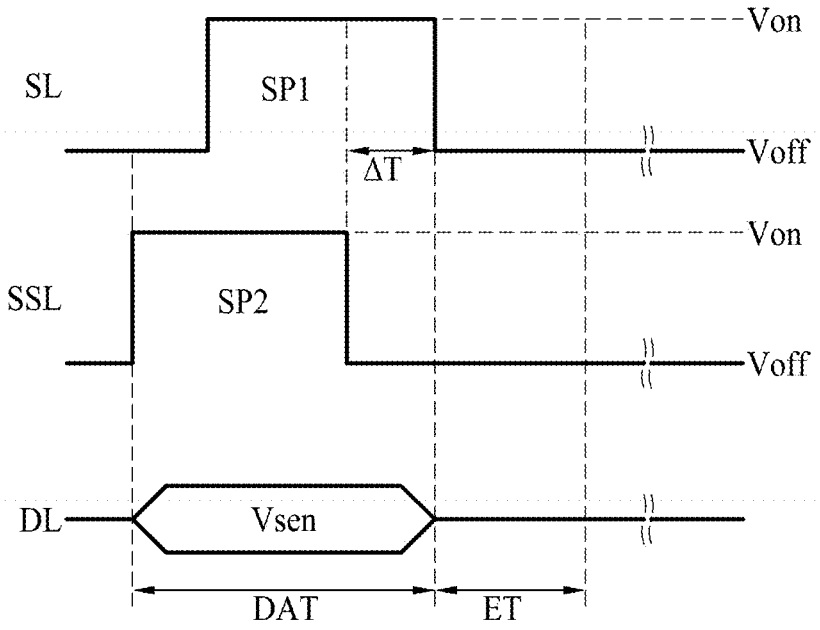
FIG. 11 is a waveform diagram showing waveforms of signals applied to each pixel during a display mode.

FIG. 11 is a driving waveform diagram of one representative pixel in the display mode in the organic light emitting display device according to an embodiment of the present invention.

A driving method of an organic light emitting display device according to an embodiment of the present invention in the display mode will be described below with reference to FIGS. 4 to 9 and 11.

In the display mode, one pixel may be divisionally driven in a data addressing period DAT and an emission period ET.

In the data addressing period DAT, as the first switching transistor Tsw1 is turned on by the first scan pulse SP1 having the gate-on voltage, a display data voltage Vdata supplied to the data line DL is supplied to the first node n1 (i.e., the gate electrode of the driving transistor Tdr). As the second switching transistor Tsw2 is turned on by the second scan pulse SP2 having the gate-on voltage, the reference voltage Vref supplied to the reference line RL is supplied to the second node n2 (i.e., the source electrode of the driving transistor Tdr).

In the data addressing period DAT, the display data voltage Vdata charged into the capacitor Cst includes a voltage for compensating for a threshold voltage of a corresponding driving transistor Tdr. Also, in order to prevent the organic light emitting device OLED from emitting light according to the driving transistor Tdr being driven with the display data voltage Vdata, the first switching transistor Tsw1 may be turned on at a certain time later than the second switching transistor Tsw2. Therefore, during the data addressing period DAT, a difference voltage "Vdata−Vref" between the display data voltage Vdata and the reference voltage Vref is charged into the capacitor Cst connected to the first node n1 and the second node n2. At this time, the organic light emitting device OLED does not emit light with the reference voltage Vref which is supplied to the second node n2 through the second switching transistor Tsw2.

It has been described above that in the data addressing period DAT, the second switching transistor Tsw2 is turned on for preventing the organic light emitting device OLED from emitting light, but the present embodiments are not limited thereto. In other embodiments, the second switching transistor Tsw2 may not operate, and in this case, a difference voltage between the display data voltage Vdata and the source voltage of the driving transistor Tdr may be charged into the capacitor Cst.

Subsequently, in the emission period ET, the first and second switching transistors Tsw1 and Tsw2 are respectively turned off by the first and second scan pulses SP1 and SP2 having the gate-off voltage. Therefore, the driving transistor Tdr is turned on by the voltage "Vdata−Vref" stored in the capacitor Cst. Therefore, the data current Ioled determined based on the difference voltage "Vdata−Vref" between the display data voltage Vdata and the reference voltage Vref flows in the organic light emitting device OLED by the turned-on driving transistor Tdr, and thus, the organic light emitting device OLED emits light in proportion to the data current Ioled flowing therein. That is, in the emission period ET, when the first and second switching transistors Tsw1 and Tsw2 are turned off, a current flows in the driving transistor Tdr, and as the organic light emitting device OLED starts to emit light in proportion to the current, a voltage of the second node n2 increases, and a voltage of the first node n1 increases by the voltage increase of the second node n2 by the capacitor Cst, whereby a gate-source voltage Vgs of the driving transistor Tdr is continuously maintained by the voltage of the capacitor Cst. Thus, the organic light emitting device OLED continuously emits light until the data addressing period DAT of a next frame. Here, the current Ioled flowing in the organic light emitting device OLED may not be affected by a threshold voltage variation of a corresponding driving transistor Tdr due to the display data voltage Vdata including a compensation voltage.

According to an embodiment of the present invention, in the above-described data addressing period DAT, the second switching transistor Tsw2 may be turned off for a predetermined time difference "Δt" earlier than the first switching transistor Tsw1, and thus, a mobility characteristic change of the driving transistor Tdr may be compensated for. In detail, when the second switching transistor Tsw2 is turned off earlier than the first switching transistor Tsw1 which is in a turn-on state, the source voltage of the driving transistor Tdr may increase by the mobility of the driving transistor Tdr based on the display data voltage Vdata, and due to the increase in the source voltage, the gate-source voltage Vgs of the driving transistor Tdr may decrease, whereby a current flowing in the organic light emitting device OLED may decrease. Accordingly, the mobility characteristic change of the driving transistor Tdr may be compensated for.

Hereinafter, a method of compensating for image quality of an organic light emitting display device according to an embodiment of the present invention will be described with reference to FIG. 12.

Figure 12:
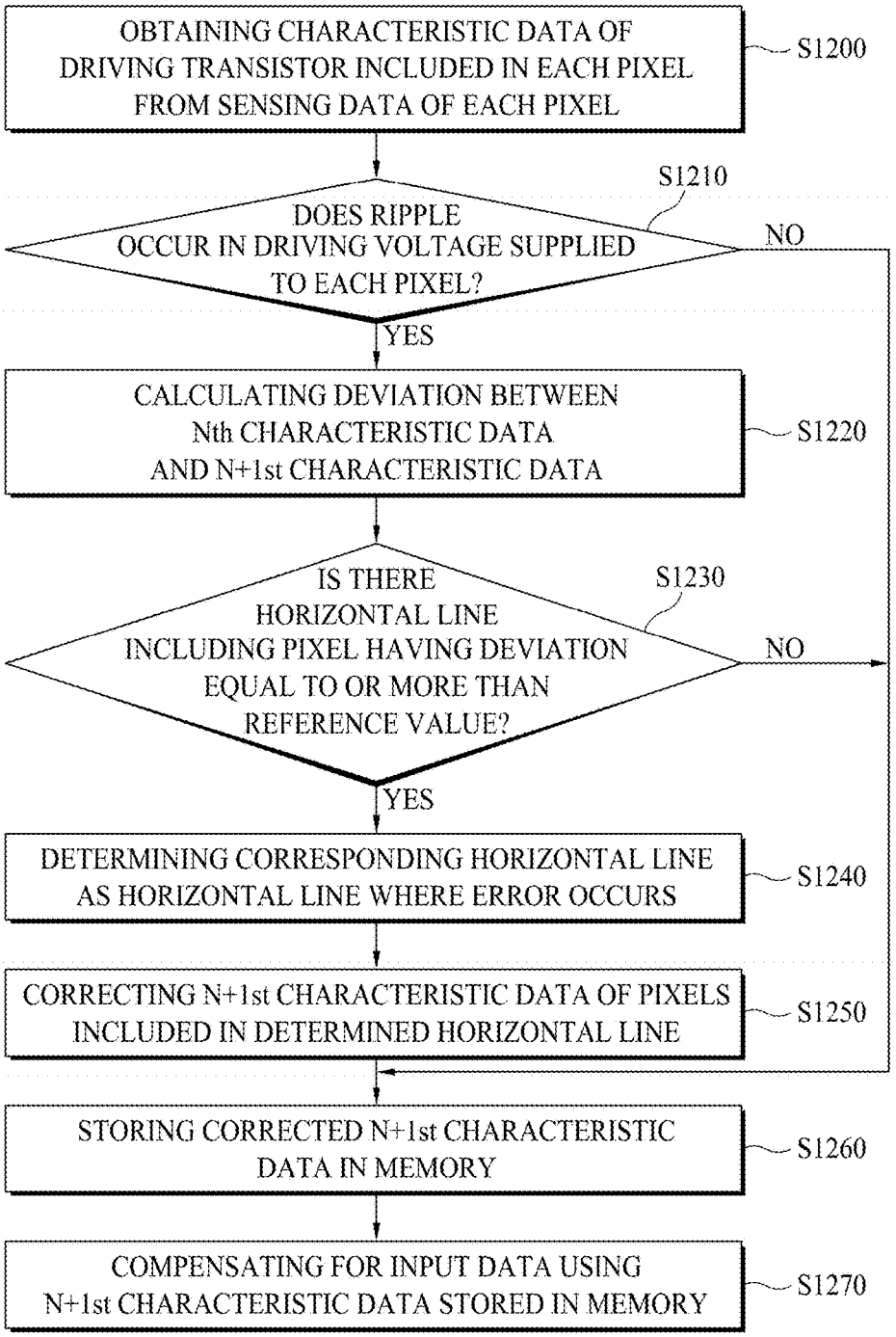
FIG. 12 is a flowchart illustrating a method of compensating for image quality of an organic light emitting display device according to an embodiment of the present invention.

FIG. 12 is a flowchart illustrating a method of compensating for image quality of an organic light emitting display device according to an embodiment of the present invention.

The method of compensating for image quality illustrated in FIG. 12 may be applied to the organic light emitting display device having a configuration illustrated in FIG. 4 and may be performed by the timing controller having a configuration illustrated in FIGS. 6 and 7.

As illustrated in FIG. 12, in operation S1200, characteristic data of a driving transistor included in each of a plurality of pixels included in a display panel is obtained from sensing data of each pixel according to the sensing mode. In an embodiment, the characteristic data of the driving transistor may include a threshold voltage or mobility of the driving transistor.

Subsequently, in operation S1210, whether ripple occurs in a driving voltage supplied to each pixel is determined. In an embodiment, when a level of the driving voltage applied to each pixel is equal to or more than a predetermined maximum value or is equal to or less than a predetermined minimum value, it may be determined that the ripple occurs in the driving voltage.

When it is determined in operation S1210 that the ripple occurs in the driving voltage, a deviation between nth characteristic data obtained through nth sensing and n+1st characteristic data obtained through n+1st sensing for the driving transistor of each pixel is calculated in operation S1220. In this case, the deviation between the nth characteristic data and the n+1st characteristic data may be calculated by subtracting the nth characteristic data from the n+1st characteristic data.

Subsequently, whether there is a horizontal line, including a pixel having a deviation equal to or more than a reference value, among horizontal lines of the display panel is determined in operation S1230. When it is determined that such a horizontal line exists, the horizontal line is determined as a horizontal line where an error occurs in operation S1240.

In detail, a deviation between nth characteristic data and n+1st characteristic data of a specific pixel may be compared with an average value of n+1st characteristic data of m number of pixels arranged above the specific pixel and n+1st characteristic data of m number of pixels arranged under the specific pixel on a vertical line including the specific pixel. When the deviation is equal to or more than the average value, a horizontal line including the specific pixel may be determined as a horizontal line where an error occurs.

Subsequently, n+1st characteristic data of pixels included in the horizontal line which is determined in operation S1240 is corrected by using n+1st characteristic data of pixels included in another horizontal line in operation S1250.

In an embodiment, n+1st characteristic data of each of pixels included in a horizontal line determined as having an error may be corrected to n+1st characteristic data of a pixel disposed just above each of pixels on a vertical line including a corresponding pixel. In this case, if the horizontal line determined as having the error is an uppermost horizontal line in the display panel, the n+1st characteristic data of each pixel included in the horizontal line determined as having the error may be corrected to n+1st characteristic data of a pixel disposed just under each of pixels on a vertical line including a corresponding pixel.

In another embodiment, n+1st characteristic data of each of pixels included in a horizontal line determined as having an error may be corrected to an average value or an intermediate value of n+1st characteristic data of m number of pixels arranged above each of pixels on a vertical line including a corresponding pixel.

In another embodiment, n+1st characteristic data of each of pixels included in a horizontal line determined as having an error may be corrected to an average value or an intermediate value of n+1st characteristic data of m number of pixels arranged under each of the pixels.

In another embodiment, n+1st characteristic data of each of pixels included in a horizontal line determined as having an error may be corrected to an average value or an intermediate value of n+1st characteristic data of m number of pixels arranged above each of the pixels and n+1st characteristic data of m number of pixels arranged under each of the pixels.

Subsequently, n+1st characteristic data which is obtained through the correction in operation S1250 is stored in a memory in operation S1260.

Subsequently, in operation S1270, input data which is to be supplied to each pixel is compensated for by using the characteristic data stored in the memory.

As described above, according to the embodiments of the present invention, compensation data may be generated based on characteristic data of a driving transistor which is sensed during the sensing period, and input data which is to be supplied to a pixel may be compensated for based on the compensation data, thereby improving image quality.

Moreover, according to the embodiments of the present invention, by correcting an error of the characteristic data caused by a variation of a driving voltage applied to the driving transistor when sensing the characteristic data of the driving transistor, a horizontal line defect of a screen caused by the error of the characteristic data may be prevented.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a determiner configured to determine whether ripple occurs in a driving voltage supplied to each of a plurality of pixels included in a display panel;

a detector configured to, when it is determined that the ripple occurs in the driving voltage, detect a horizontal line having an error, based on a deviation between nth characteristic data obtained through nth sensing and n+1st characteristic data obtained through n+1st sensing for a driving transistor of each pixel;

a data corrector configured to correct n+1st characteristic data of pixels included in the horizontal line having the error using n+1st characteristic data of pixels included in another horizontal line and store the corrected n+1st characteristic data in a memory; and a data processor configured to compensate for input data which is to be supplied to each pixel using the characteristic data stored in the memory, wherein when a deviation between nth characteristic data and n+1st characteristic data of a specific pixel is equal to or more than an average value of n+1st characteristic data of m number of pixels arranged above the specific pixel and n+1st characteristic data of m number of pixels arranged under the specific pixel on a vertical line including the specific pixel, the detector detects a horizontal line including the specific pixel as the horizontal line where the error occurs.

2. The organic light emitting display device of claim 1, wherein the determiner comprises:

a first comparator configured to determine whether a level of the driving voltage supplied to each pixel is equal to or more than a maximum value;

a second comparator configured to determine whether the level of the driving voltage supplied to each pixel is equal to or less than a minimum value; and a determination unit configured to determine the ripple as occurring in the driving voltage when the level of the driving voltage is equal to or more than the maximum value or is equal to or less than the minimum value.

3. The organic light emitting display device of claim 1, wherein the corrector corrects n+1st characteristic data of each of pixels, included in the detected horizontal line, to n+1st characteristic data of a pixel disposed just above each of pixels on a vertical line including a corresponding pixel, and if the detected horizontal line is an uppermost horizontal line, the corrector corrects the n+1st characteristic data of each pixel, included in the detected horizontal line, to n+1st characteristic data of a pixel disposed just under each of pixels on a vertical line including a corresponding pixel.

4. The organic light emitting display device of claim 1, wherein the corrector corrects n+1st characteristic data of each of pixels, included in the detected horizontal line, to an average value of n+1st characteristic data of m number of pixels arranged above each of pixels on a vertical line including a corresponding pixel, an average value of n+1st characteristic data of m number of pixels arranged under each of the pixels, or an average value of n+1st characteristic data of m number of pixels arranged above each of the pixels and n+1st characteristic data of m number of pixels arranged under each of the pixels.

5. A method of compensating for image quality of an organic light emitting display device, the method comprising:

determining whether ripple occurs in a driving voltage supplied to each of a plurality of pixels included in a display panel;

when it is determined that the ripple occurs in the driving voltage, detecting a deviation between nth characteristic data obtained through nth sensing and n+1st characteristic data obtained through n+1st sensing for a driving transistor of each pixel;

detecting a horizontal line, including a pixel where the deviation is equal to or more than a reference value, from among horizontal lines of the display panel;

correcting n+1st characteristic data of pixels included in the detected horizontal line using n+1st characteristic data of pixels included in another horizontal line; and compensating for input data which is to be supplied to each pixel using the corrected n+1st characteristic data, wherein the detecting comprises:

comparing a deviation between nth characteristic data and n+1st characteristic data of a specific pixel with an average value of n+1st characteristic data of m number of pixels arranged above the specific pixel and n+1st characteristic data of m number of pixels arranged under the specific pixel on a vertical line including the specific pixel; and when the deviation is equal to or more than the average value, detecting a horizontal line including the specific pixel as the horizontal line where the error occurs.

6. The method of claim 5, wherein the determining comprises determining ripple as occurring in the driving voltage when a level of the driving voltage is equal to or more than a maximum value or is equal to or less than a minimum value.

7. The method of claim 5, wherein the correcting comprises:

correcting n+1st characteristic data of each of pixels, included in the detected horizontal line, to n+1st characteristic data of a pixel disposed just above each of pixels on a vertical line including a corresponding pixel; and if the detected horizontal line is an uppermost horizontal line, correcting the n+1st characteristic data of each pixel, included in the detected horizontal line, to n+1st characteristic data of a pixel disposed just under each of pixels on a vertical line including a corresponding pixel.

8. The method of claim 5, wherein the correcting comprises correcting n+1st characteristic data of each of pixels, included in the detected horizontal line, to an average value of n+1st characteristic data of m number of pixels arranged above each of pixels on a vertical line including a corresponding pixel, an average value of n+1st characteristic data of m number of pixels arranged under each of the pixels, or an average value of n+1st characteristic data of m number of pixels arranged above each of the pixels and n+1st characteristic data of m number of pixels arranged under each of the pixels.

* * * * *